US010994219B2

(12) United States Patent
Lunde et al.

(10) Patent No.: US 10,994,219 B2
(45) Date of Patent: May 4, 2021

(54) SIMULATED FIRE EFFECT USING STEAM

(71) Applicant: Technifex Products, LLC, Valencia, CA (US)

(72) Inventors: Montgomery C. Lunde, Marina del Rey, CA (US); Ryan G. Lunde, Santa Clara, CA (US); Matthew A. Case, Sylmar, CA (US)

(73) Assignee: Technifex, Inc., Valencia, CA (US)

( * ) Notice: Subject to any disclaimer, the term of this patent is extended or adjusted under 35 U.S.C. 154(b) by 256 days.

(21) Appl. No.: 16/189,098

(22) Filed: Nov. 13, 2018

(65) Prior Publication Data

US 2019/0143240 A1 May 16, 2019

Related U.S. Application Data

(60) Provisional application No. 62/585,486, filed on Nov. 13, 2017.

(51) Int. Cl.

| | |
|---|---|
| ***A63J 5/02*** | (2006.01) |
| ***F17C 7/04*** | (2006.01) |
| ***A63J 25/00*** | (2009.01) |
| ***F21S 10/04*** | (2006.01) |

(52) U.S. Cl.

CPC ..... *A63J 5/025* (2013.01); *A63J 5/023* (2013.01); *A63J 25/00* (2013.01); *F17C 7/04* (2013.01); *F21S 10/04* (2013.01)

(58) Field of Classification Search

None

See application file for complete search history.

(56) References Cited

U.S. PATENT DOCUMENTS

| | | | | |
|---|---|---|---|---|
| 643,493 | A | 2/1900 | Fuller | |
| 3,044,301 | A * | 7/1962 | Bennett | B64G 7/00 73/865.6 |
| 3,334,816 | A * | 8/1967 | Mizuno | B05B 17/08 239/18 |
| 3,432,439 | A | 3/1969 | Dickman | |
| 4,002,333 | A | 1/1977 | Gotoh | |
| 4,026,544 | A | 5/1977 | Plambeck et al. | |
| 4,426,021 | A | 1/1984 | Rosenthal | |
| 4,568,288 | A * | 2/1986 | Patteson | G09B 25/02 434/219 |

(Continued)

FOREIGN PATENT DOCUMENTS

DE 3921407 A1 1/1991

*Primary Examiner* — Thor S Campbell

(74) *Attorney, Agent, or Firm* — James A. Sheridan; Sheridan Law, LLC

(57) ABSTRACT

The invention is directed to special effect device that is used to produce a simulated flame that has the shape and, if desired, the color characteristics of an actual flame. The device is particularly adapted to applications in which individuals may be in close proximity to the device. In this regard, the device produces little noise that would indicate to such an individual that the simulated being produced by the device is not a real flame. In one embodiment, the device includes a sintered nozzle that receives a stream of steam and outputs a steam cloud, a steam accelerator for applying a linear stream of air to steam cloud output by the sintered nozzle, and a lighting system to project desired colors onto the linear steam cloud.

11 Claims, 5 Drawing Sheets

(56) References Cited

U.S. PATENT DOCUMENTS 4,907,330 A * 3/1990 Akao ..... F02B 19/165 123/90.51
4,974,779 A * 12/1990 Araki ..... G03B 21/608 239/18
4,994,092 A 2/1991 Eklund et al.
5,156,333 A 10/1992 Worsfold
5,407,392 A 4/1995 Laijoki-Puska
5,550,610 A * 8/1996 DeMarco ..... G03B 11/00 396/544
5,790,013 A 8/1998 Hauck
5,882,717 A * 3/1999 Panesar ..... A23F 5/40 426/595
5,989,128 A 11/1999 Baker et al.
6,363,636 B1 4/2002 Hess et al.
6,685,574 B2 2/2004 Hall
6,802,782 B2 10/2004 Hall et al.
6,953,401 B2 10/2005 Starr
7,300,179 B1 11/2007 LaDuke et al.
7,641,361 B2 1/2010 Wedell et al.
7,686,471 B2 3/2010 Reichow
7,762,897 B2 7/2010 Starr et al.
7,837,355 B2 11/2010 Schnuckle
7,850,533 B2 12/2010 Osterman et al.
8,028,438 B2 10/2011 Pedtke
8,070,319 B2 12/2011 Schnuckle et al.
8,342,712 B2 1/2013 Patton et al.
8,523,692 B2 9/2013 Osterman et al.
8,534,869 B2 9/2013 Patton et al.
8,550,660 B2 10/2013 Patton et al.
8,646,946 B2 2/2014 Schnuckle et al.
8,696,166 B2 4/2014 Patton et al.
8,721,118 B2 5/2014 Patton et al.
8,727,569 B2 5/2014 Schnuckle et al.
8,800,933 B2 8/2014 Dunn
9,068,706 B2 6/2015 Fournier et al.
9,366,402 B2 6/2016 Li
9,371,973 B2 6/2016 Li
9,384,673 B1 7/2016 Jahnke
9,447,937 B2 9/2016 Fournier et al.
9,447,938 B2 9/2016 Li
9,512,971 B2 12/2016 Li
9,518,710 B2 12/2016 Li
9,523,471 B2 12/2016 Li
9,551,470 B2 1/2017 Li
9,585,980 B1 3/2017 Li
9,605,824 B1 3/2017 Li
9,625,112 B2 4/2017 Li
9,689,538 B2 6/2017 Hau et al.
9,689,544 B2 * 6/2017 Green, Jr. ..... H05B 45/10
9,695,839 B1 * 7/2017 Polston ..... F04F 1/18
9,709,231 B2 7/2017 Li
9,739,432 B2 8/2017 Li
9,810,388 B1 11/2017 Li
9,949,346 B2 4/2018 Patton
10,010,640 B1 7/2018 Li
10,018,313 B2 7/2018 Schnuckle et al.
10,018,362 B1 * 7/2018 Swanson ..... F24B 1/183
10,024,507 B2 7/2018 Fournier et al.
10,060,585 B2 8/2018 Li
10,111,307 B2 10/2018 Li
10,112,203 B2 * 10/2018 Kubicek ..... A61L 9/122
10,125,937 B2 11/2018 Green, Jr. et al.
10,145,562 B1 * 12/2018 Swanson ..... F24C 7/004
10,675,553 B1 * 6/2020 Witt ..... A63J 5/02
2003/0190966 A1 * 10/2003 Hall ..... A63J 5/023 472/65
2004/0077416 A1 * 4/2004 Hall ..... A63J 5/023 472/57
2005/0101393 A1 * 5/2005 Starr ..... A63J 5/023 472/65
2006/0275721 A1 * 12/2006 Starr ..... G09F 19/12 431/125
2008/0112154 A1 5/2008 Reichow
2008/0146358 A1 6/2008 Osterman et al.
2008/0291663 A1 * 11/2008 Wedell ..... F21V 19/0055 362/147
2010/0031543 A1 2/2010 Rice et al.
2011/0019422 A1 1/2011 Schnuckle et al.
2011/0045302 A1 2/2011 Osterman et al.
2011/0127914 A1 6/2011 Patton et al.
2014/0168946 A1 * 6/2014 Kaplan ..... A63J 5/025 362/96
2015/0103510 A1 * 4/2015 Reetz ..... F21S 10/00 362/84
2015/0338086 A1 11/2015 Patton
2018/0347818 A1 * 12/2018 Birnbaum ..... F24C 7/004

* cited by examiner

FIG. 1D
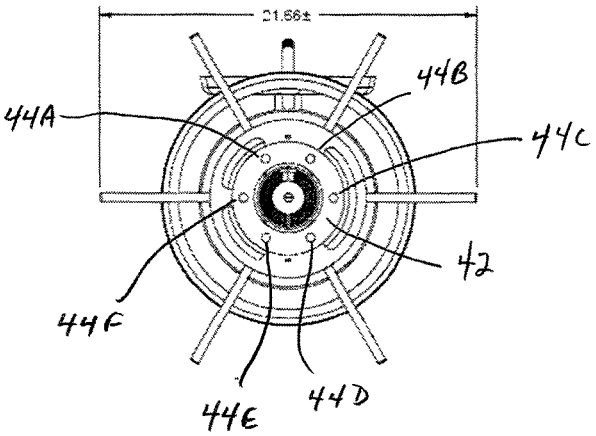
FIG. 1C
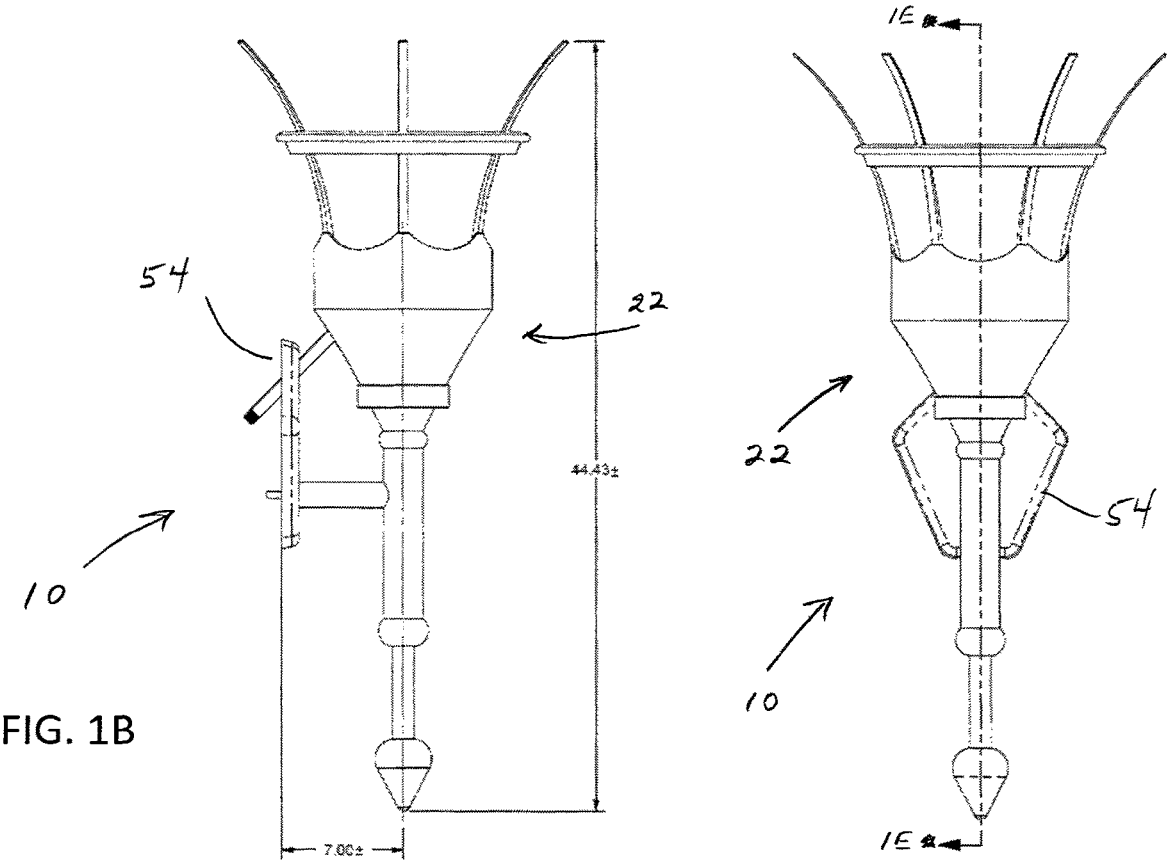
FIG. 1B

SECTION C-C

SIMULATED FIRE EFFECT USING STEAM

CROSS REFERENCE TO RELATED APPLICATIONS

This application claims the benefit of U.S. provisional patent application No. 62/585,486, entitled "Simulated Fire Effect Using Steam" and filed on Nov. 13, 2017, which application is incorporated by reference into this application in its entirety.

FIELD OF THE INVENTION

The present invention is directed to a special effect device and, more specifically, to a special effect for producing simulated flame or fire effect using steam.

BACKGROUND OF THE INVENTION

The use of a simulated fire or flame is desirable in many applications. For instance, in many theme park attractions (e.g., volcano, battle scene and disaster scenes), the use of a simulated flame or fire is preferred relative to a real flame or fire for a number of reasons. For instance, a real flame or fire must typically be located a substantial distance from an audience to prevent members of the audience from coming into contact with the fire or flame. Further, with respect to attractions that are located indoors, a real flame or fire produces heat and smoke that typically require additional air conditioning and ventilation. In contrast, several types of simulated flame or fire effects can be located close to an audience and do not typically impose the air conditioning and ventilation requirements of a real flame or fire.

There are many types of devices for producing simulated flames or fire. For example, one type of device blows strips of colored material, such as silk, up into the air and shines an appropriately colored light onto the strips. From a distance, these devices provide a reasonably convincing simulated flame or fire. At the other end of the spectrum are devices that provide a television or video monitor with a signal of a pre-recorded fire or flame. Such devices are impractical in theme park applications that require a flame or fire that extends over a distance that is greater than the typical width and height of a video monitor or television. Yet a further type of device involves the use of a screen of atomized water and the projection of an image or light on the screen that creates the illusion of a flame or fire. Also known are devices that use theatrical smoke or steam in creating the illusion of a fire or flame. Among these devices are the devices disclosed in U.S. Pat. Nos. 6,685,574, 6,802,782, 6,953,401, and 7,762,897.

SUMMARY OF THE INVENTION

The invention is directed to a special effect device that uses steam to produce a simulated flame effect. More specifically, the device is adapted to be used in applications in which individuals may come in close proximity to the device. Among these applications are theme park rides and restaurants (e.g., a restaurant with a Tiki theme). In such applications, it is desirable that the device not make or minimize the making of any noise that would indicate to a nearby individual that the simulated flame being produced by the device is not a real flame.

In one embodiment, the device includes a pipe that extends from a first end to the second end, the first end being adapted to receive steam produced a boiler and the second end expelling the received steam. Attached to the second end of the pipe is a sintered nozzle that, in use, receives steam from the pipe and outputs a steam cloud. A steam accelerator is disposed adjacent to the sintered nozzle and produces a linear stream of air that is applied to the steam cloud output by the sintered nozzle to produce a steam cloud with a linear flow characteristic. A lighting structure is positioned to project light on the steam cloud produced adjacent to the sintered nozzle. In operation, the device substantially avoids making the "gurgling" type noises associated with other such devices that would indicate to a nearby individual that the simulated flame is unlikely to be a real flame. In a particular embodiment, the steam accelerator includes an electric fan and a flow straightener that receives a flow of air from the fan and outputs the linear flow of air that is applied to a steam cloud produced adjacent to the sintered nozzle. Alternatively, an air amplifier can be used to produce the linear flow of air that is applied to the steam cloud.

In certain situations, the steam cloud with the linear flow characteristic that results from the application of the linear flow of air produced by the steam accelerator to the steam cloud output by the sintered nozzle is too linear or does not interact with the ambient air sufficiently to take on the shape of an actual flame. As such, in another embodiment, a deflector is positioned adjacent to the sintered nozzle so as to disrupt the steam cloud with the linear flow characteristics in a manner that produces a steam cloud with a shape that more closely resembles the shape of an actual flame.

In yet another embodiment, a framework is associated with the device that connects the sintered nozzle, steam accelerator, and lighting structure to one another so that these portions of the device have a T-shape with the sintered nozzle and steam accelerator forming the upright-portion of the T-shape and the lighting structure forming the cross-portion of the T-shape. Providing this fixed shape for the device facilitates the design of whatever "skin" is to be applied over the device in a particular application.

BRIEF DESCRIPTION OF THE DRAWINGS

FIGS. 1A-1D respectively are perspective, side, front, and top views of a first embodiment of a special effect device for use in producing a simulated flame or fire effect using stem, the device being "skinned" so as to appear to be a wall-mounted torch;

DETAILED DESCRIPTION

Figure 1A:
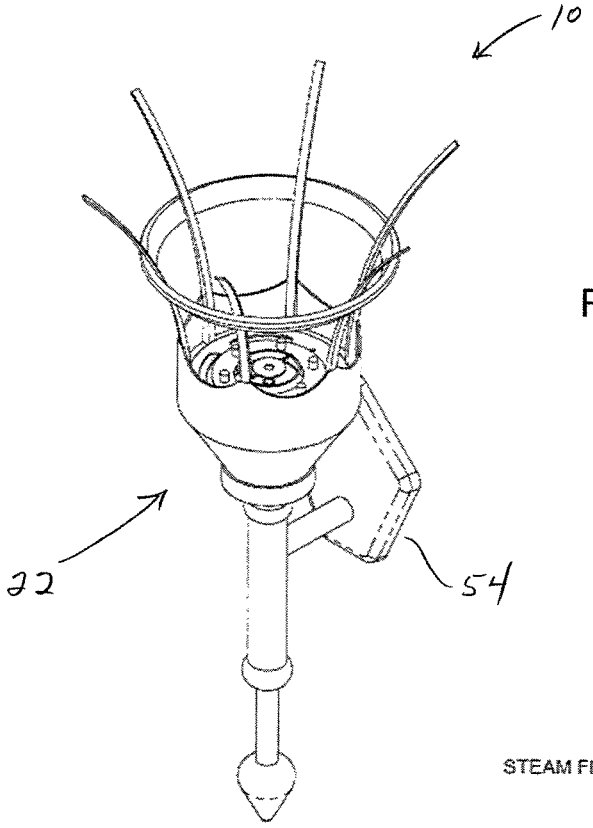
Figure 1E:
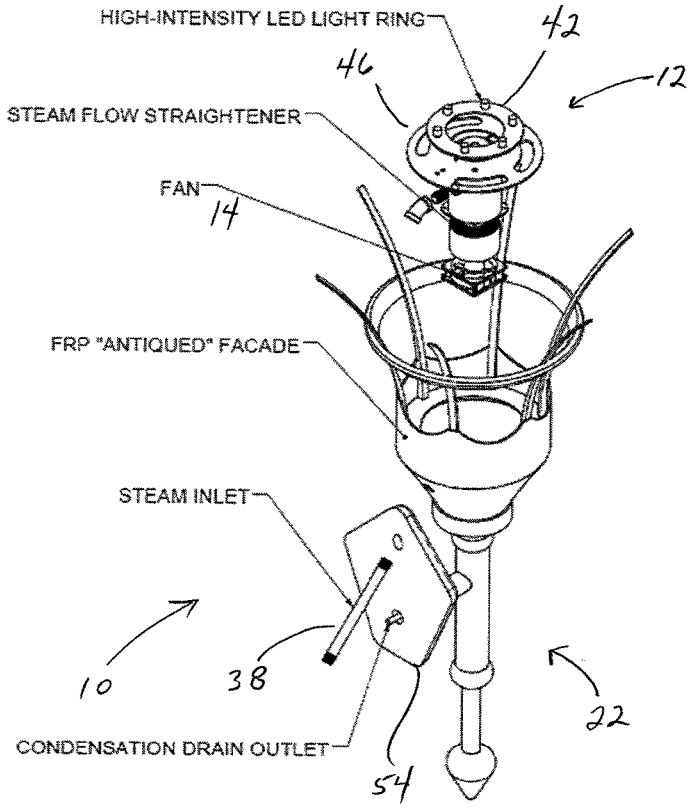
FIG. 1E is a partially exploded view of the embodiment of the special effect device shown in FIGS. 1A-1D.
Figure 1F:
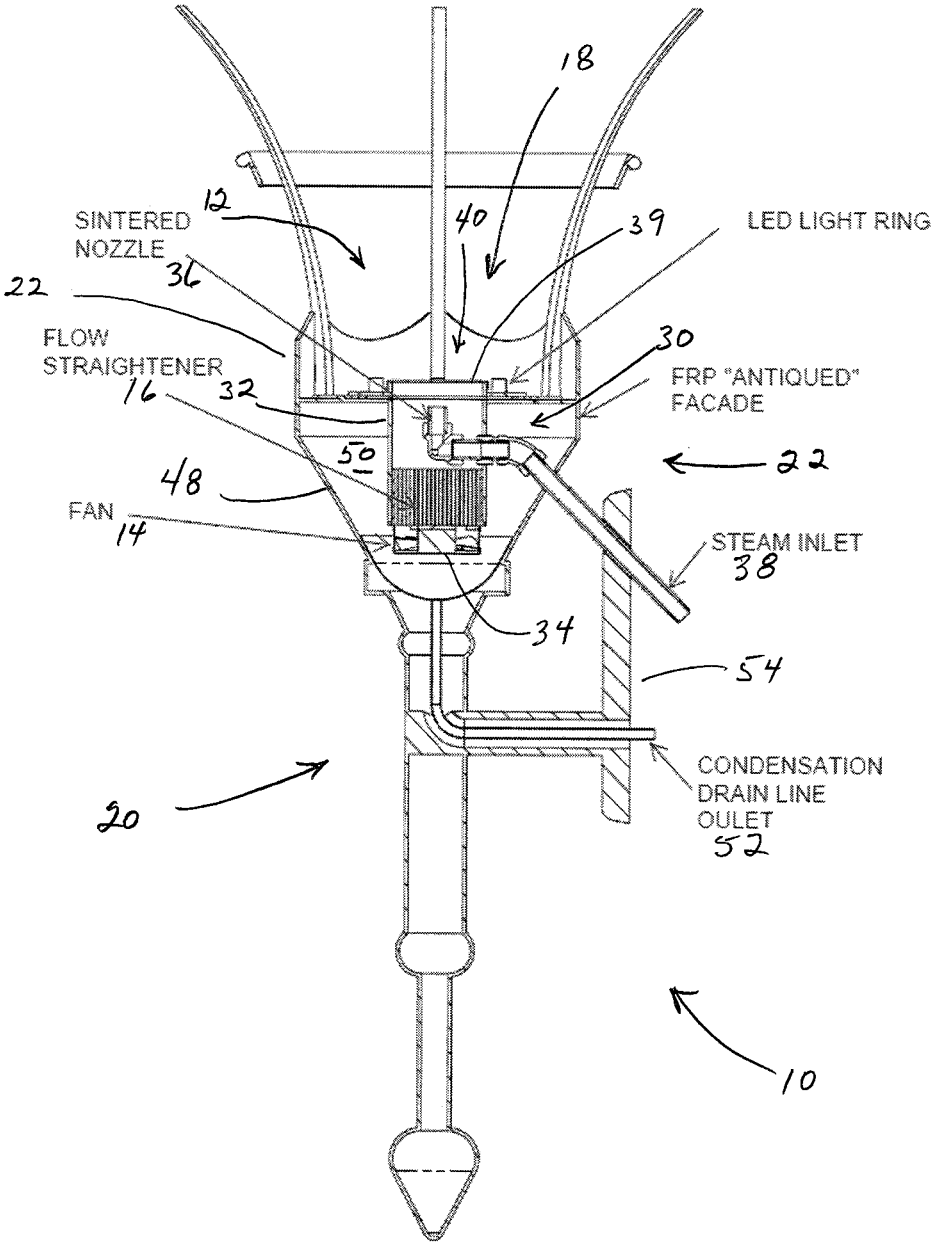
FIG. 1F is a cross-sectional view of the embodiment of the special effect device shown in FIGS. 1A-1D.

With reference to FIGS. 1A-1F, an embodiment of a special effect device 10, which is hereinafter referred to as device 10, that uses steam to produce a simulated flame or fire effect is described. Generally, the device 10 includes a steam cloud system 12 for producing a cloud of steam, fan 14 for producing an air flow, a flow straightener 16 for receiving the flow of air produced by the fan 14 and outputting a more linear flow of air that is applied to the steam cloud produced by the steam cloud system 12 so as to produce a generally upwardly extending steam cloud, a light system 18 for producing light that is directed onto the upwardly extending steam cloud so that the resulting simulated flame has the color or colors of an actual flame, a drainage system 20 for removing condensation resulting from the cooling of the steam cloud, and an outer skin 22 that makes the device 10 appear to be a wall-mounted torch. It should be appreciated that outer skins that make the device appear to something other than a wall mounted torch are feasible. In operation, the steam cloud system 12 produces a steam cloud. The fan 14 produces a flow of air that is applied to the flow straightener 16, which processes the flow of air so as to output a straighter or more linear flow of air. This straighter flow of air is applied to the steam cloud so as to produce a generally upwardly extending steam cloud. While not wishing to be bound by theory, it is believed that the interaction between the warm, moist steam cloud and the cooler and dryer air causes modulation of the steam cloud in a manner that simulates the movement of an actual flame. The light system 18 directs light onto the generally upwardly extending steam cloud with the color or colors of the light being chosen so as to simulate the colors of an actual flame.

With continuing reference to FIGS. 1A-1F, the device 10 is described in greater detail. The device 10 includes a housing 30 with a cylindrical side surface 32 and porous bottom surface 34. The cylindrical side surface 32 and porous bottom surface 34 define an interior space. The flow straightener 16 is located in the bottom portion of this interior space. The flow straightener 16 is characterized by having a large number of substantially parallel channels that each receive a portion of the air stream produced by the fan 14 and operate on the portion of the air stream to straighten or linearize the portion of the air stream. The top portion of the interior space houses a sintered nozzle 36 that is connected to a conduit 38 which directs a flow of steam to the nozzle. The sintered nozzle 36 is a solid, sponge-like structure that, in operation, disperses steam through a large number of small orifices and thereby produces a dispersed cloud of steam within the top portion of the interior space. Further, the operation of the sintered nozzle 36 is relatively quiet compared to a conventional single-orifice nozzle or comparable nozzle. The cylindrical side surface 32 has an upper edge 39 that defines an opening 40 through which, in operation, the steam cloud passes.

The fan 14 is operatively connected to the housing 30 so as to be disposed adjacent to the porous bottom surface 34 of the housing 30. The fan 14 operates so as to produce an air flow that is directed through the porous bottom surface 34 of the housing 30 and into the flow straightener 16.

Disposed adjacent to the upper edge 39 of the cylindrical side surface 32 is a light support ring 42 that supports LED lights 44A-44F. The LED lights 44A-44F are supported so as to direct, in operation, the light produced by the lights towards the upwardly extending cloud of steam located above the opening 40. A support ring 46 engages the housing 30 and an interior surface of the skin 22 so as to support the housing 30 in the desired orientation. The support ring 46, the housing 30, and a portion 48 of the skin 22 define a cone-shaped interior space 50. A drainage conduit 52 extends from the bottom of the cone-shaped interior space 50 to a remote location at which any water draining through the conduit 52 can be collected or flushed.

The outer skin 22 is formed so as to have the appearance of a torch. A bracket 54 engages the outer skin 22 so as to provide a surface for attaching the device 10 to a wall or other suitable surface. The bracket 54 also serves to support and at least partially disguise the steam conduit 38 and the drainage conduit 52. The drainage conduit 52 also provides a path from the electrical leads needed to provide power to the fan 14. In the illustrated embodiment, the skin 22 also extends sufficiently above the housing 30, light support ring 42, and support ring 46 so that, when the device 10 is mounted on a wall at an appropriate distance above ground level, the average height observer is unlikely to see the lights 44A-44F and other elements of the device that are being used to create the simulated flame.

Operation of the device 10 includes providing steam to the sintered nozzle 36 via the steam conduit 38. In response, the sintered nozzle 36 produces a steam cloud in the upper portion of the interior space defined by the housing 30. The fan 14 produces an air flow that is applied to the inlet side of the flow straightener 14. The straightener operates on the air flow so as to produce a straighter or more linear air flow at the outlet of the flow straightener 16. The straighter or more linear air flow interacts with the steam cloud exiting the sintered nozzle 36 so as to produce an upwardly extending steam cloud. This upwardly extending steam cloud is sufficiently modulated by ambient eddy currents so as to suitably simulate the movement of an actual flame. The LED lights 44A-44F produce light that is projected on to the upwardly extending steam cloud. The colors of the light are chosen so as to simulate the colors associated with an actual flame that might be produced using an actual torch. It should, however, be appreciated that any desired color or colors can be produced and projected on to the upwardly extending steam cloud.

Figure 2A:
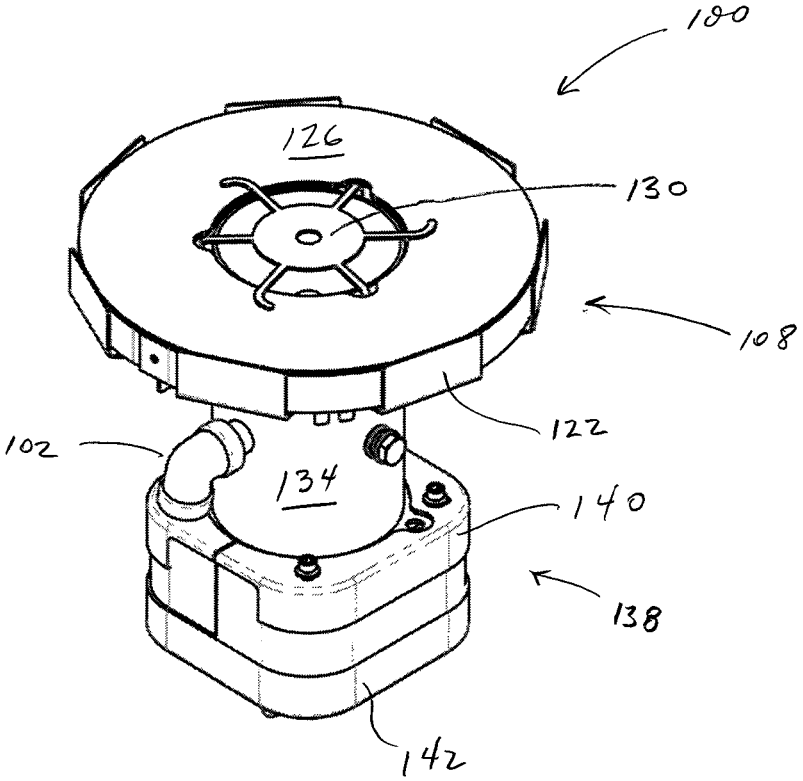
FIGS. 2A-2D respectively illustrate a perspective view, side view, cross-sectional, and exploded view of a second embodiment of a special effect device for use in producing a simulated flame or fire effect.
Figure 2B:
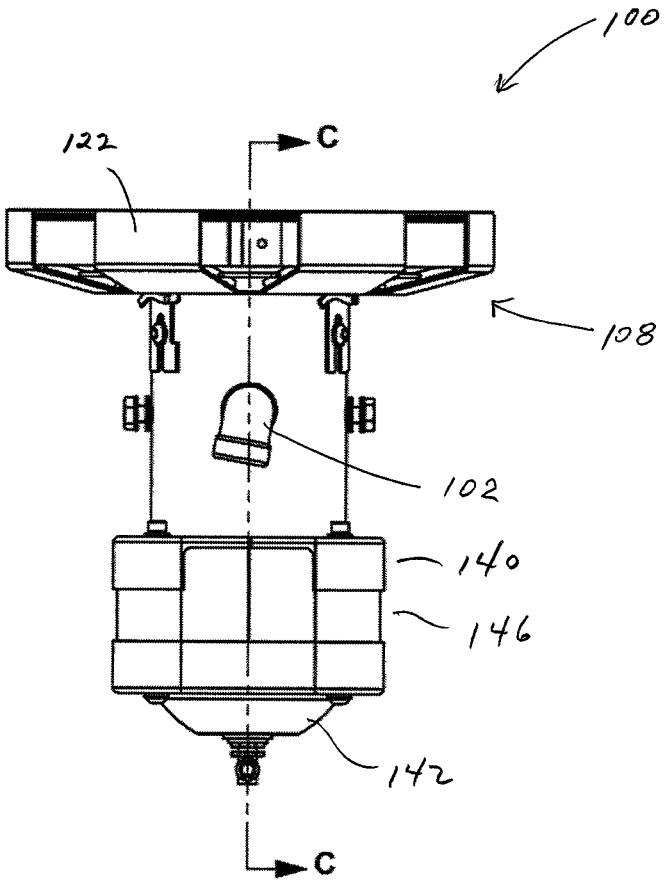
Figure 2C:
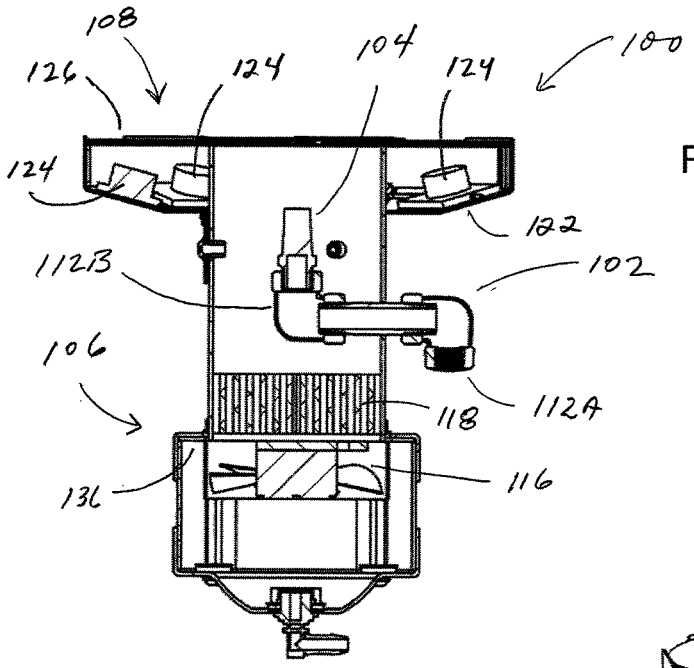
Figure 2D:
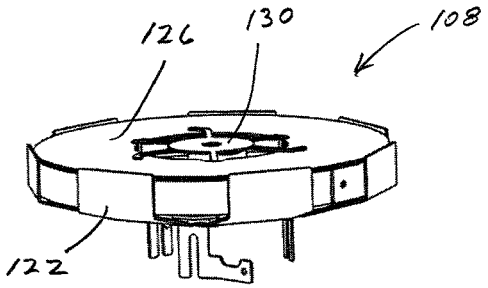
Figure 2D:
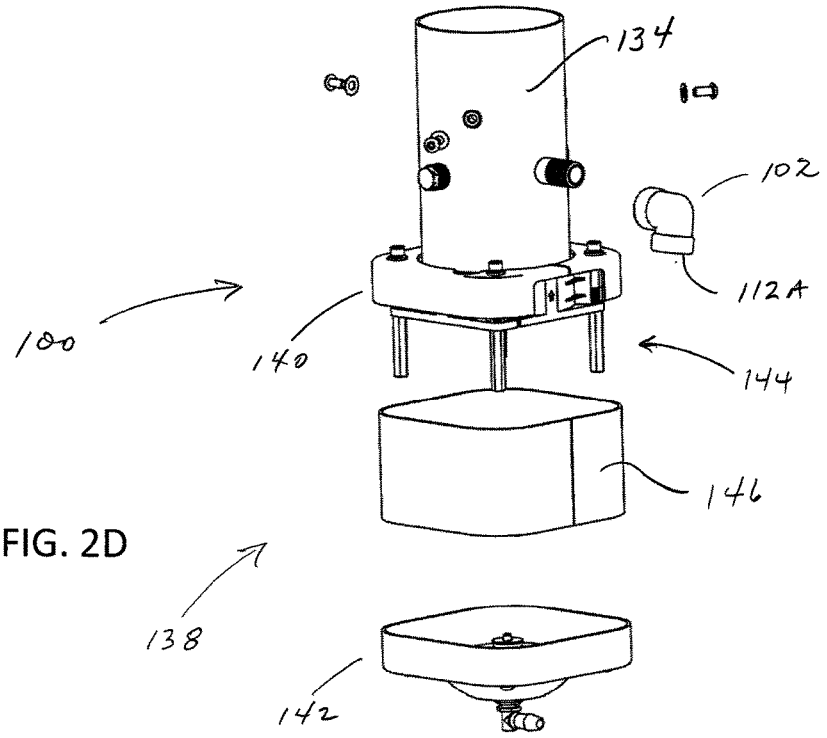

With reference to FIGS. 2A-2D, a second embodiment of a device for use in producing a fire special effect, hereinafter device 100, is described. Generally, the device 100 include a piping structure 102 for conveying steam from a boiler (not shown), a sintered nozzle 104 for receiving steam from the pipe structure 102 and producing a steam cloud adjacent to the nozzle, a steam accelerator 106 for producing a stream of linearly flowing air for application to a steam cloud produced adjacent to the sintered nozzle 104, and a lighting system 108 for producing light that is applied to a steam cloud located adjacent to the sintered nozzle 104. In operation, the sintered nozzle 104 receives steam from the pipe and outputs a steam cloud that extends away from the nozzle 104. The steam accelerator 106 produces a linear flow of air that is applied to the steam cloud output by the sintered nozzle to produce a steam cloud with a linear characteristic. The light system 108 produces light that is applied to the steam cloud to produce a simulated flame.

With continuing reference to FIGS. 2A-2D, the device 100 is described in greater detail. The piping structure 102 extends from a first terminal end 112A to a second terminal end 112B. In operation, the first terminal end 112A is operatively connected to other piping that conveys steam from a boiler to the pipe 102. The second terminal end 112B of the pipe 102 is operatively connected to the sintered nozzle 104.

The steam accelerator 106 is comprised of an electric fan 116 and a flow straightener 118 positioned so as to receive a flow of air from the fan 116 and output a linear flow of air for application to a steam cloud produced adjacent to the sintered nozzle 104.

The lighting system 108 includes a pan 122 that supports a number of LED lights 124 and a colored gel 126. In operation, the LED lights 124 produce white light that, upon transmission through the gel 126, becomes colored light that is applied to the steam cloud produced adjacent to the sintered nozzle 104. The pan 122 also supports an optional deflector 130. The deflector 130 operates to break-up or spread the linear steam cloud produced by the operation of the sintered nozzle 104 and the steam accelerator 106.

Breaking up the linear flowing steam cloud is required in some applications to achieve a steam cloud with a shape more closely resembling the shape of a real flame.

An open-ended cylinder 134 serves to constrain the steam cloud produced adjacent to the sintered nozzle 104. Further, the cylinder 134 serves as a structural member that supports the piping structure 102 and the lighting structure 108. Additionally, the cylinder 134 houses the flow straightener 118. The cylinder 134 also has a flange 136 that facilitate the connection of a fan housing structure 138. The fan housing structure 138 includes a top portion 140 that engages the flange 136 of the cylinder 134, a bottom portion 142 that is adapted to drain condensation associated with the operation of the device 100, spacers 144 that position the top portion 140 and the bottom portion 142 at a desired distance from one another so provide a space through which air be drawn by the fan 116. A screen 146 extends between the top portion 140 and bottom portion 142 that allows air to be drawn by the fan 116 while also preventing foreign objects from coming into contact with fan 116. Notably, the device 100 has a T-shape with the lighting structure 108 defining the cross-portion of the T-shape and the structures associated with the sintered nozzle 104 steam accelerator 106 defining the upright-portion of the T-shape. As such, the device 100 has a standardized exterior shape that facilitates the production of whatever "skin" is desired for a particular application.

The foregoing description of the invention is intended to explain the best mode known of practicing the invention and to enable others skilled in the art to utilize the invention in various embodiments and with the various modifications required by their particular applications or uses of the invention.

What is claimed is:

1. A special effect device for use in creating a simulated flame effect using steam, the device comprising:

a pipe for conveying a stream of steam from a first terminal end of the pipe to a second terminal end of the pipe;

a sintered nozzle configured for receiving a stream of steam from the second terminal end of the pipe and configured for producing a steam cloud that extends away in a direction defined by a longitudinal axis from the sintered nozzle and the second terminal end of the pipe;

a steam accelerator disposed adjacent to the second terminal end of the pipe, the steam accelerator configure for applying a linear stream of air, and the stream accelerator configured for applying the linear stream of air in a direction parallel to, and in a surrounding configuration with, the longitudinal axis of the steam cloud produced adjacent to the sintered nozzle so as produce a linear steam cloud extending away from the sintered nozzle; and a lighting structure adapted to project light onto a steam cloud extending away from the sintered nozzle so as to create an illusion of a flame.

2. A special effect device, as claimed in claim 1, further comprising:

a deflector positioned adjacent to the sintered nozzle for causing a linear stream cloud extending away from the sintered nozzle to spread.

3. A special effect device, as claimed in claim 1, wherein the steam accelerator comprising:

a fan adapted to produce a stream of air;

a flow straightener having an input side positioned to receive a stream of air produced by the fan and an output side positioned to apply a linearized stream of air to a steam cloud produced adjacent to the sintered nozzle.

4. A special effect device, as claimed in claim 1, wherein:

the light structure includes a light and a colored gel located between the light and a steam cloud produced adjacent to the sintered nozzle.

5. A special effect device, as claimed in claim 1, further comprising:

a frame structure for connecting the sintered nozzle, steam accelerator, and lighting structure to one another so as to have a T-shape with the lighting structure being associated the crossed-portion of the T-shape and the sintered nozzle and steam accelerator being associated with the upright-portion of the T-shape.

6. A special effect device for creating a simulated flame effect using steam, the device comprising:

a pipe for conveying a stream of steam from a first terminal end of the pipe to a second terminal end of the pipe;

a fan adapted to produce a stream of air;

a flow straightener having an input side positioned to receive a stream of air produced by the fan, an output side positioned to apply a linearized stream of air to a steam cloud produced adjacent to the second terminal end of the pipe to produce a linear steam cloud extending away from the second terminal end of the pipe, and a plurality of parallel channels disposed between the input side and the output side, each one of the parallel channels configured to receive a portion of the stream of air produced by the fan, and each one of the parallel flow channels configured to linearize the portion of the stream of air; and a lighting structure positioned to project light onto a space to be occupied by a steam cloud extending away from the second terminal end of the pipe so as to create an illusion of a flame.

7. A special effect device, as claimed in claim 6, further comprising:

a sintered nozzle connected to the second terminal end of the pipe.

8. A special effect device, as claimed in claim 7, further comprising:

deflector positioned adjacent to the sintered nozzle for causing a steam cloud produced adjacent to the sintered nozzle to spread.

9. A special effect device, as claimed in claim 6, further comprising:

deflector positioned adjacent to the second terminal end of the pipe for causing a steam cloud produced adjacent to the second terminal end of the pipe to spread.

10. A special effect device, as claimed in claim 6, wherein:

the light structure includes a light and a colored gel located between the light and a steam cloud produced adjacent to the second terminal end of the pipe.

11. A special effect device, as claimed in claim 6, further comprising:

a frame structure for connecting the fan, flow straightener, and lighting structure to one another so as to have a T-shape with the lighting structure being associated the crossed portion of the T-shape and the fan and flow straightener being associated with the upright portion of the T-shape.

* * * * *